United States Patent [19]

Castillo

[11] 4,441,564

[45] Apr. 10, 1984

[54] PORTABLE VARIABLE ANGLE DRILLING MACHINE

[76] Inventor: Michael S. Castillo, 23011 Moulton Pkwy., #C-8, Laguna Hills, Calif. 92653

[21] Appl. No.: 280,128

[22] Filed: Jul. 27, 1981

[51] Int. Cl.[3] ..... E22C 11/00

[52] U.S. Cl. ..... 175/122; 175/62; 173/37; 173/163

[58] Field of Search ..... 175/122, 394, 61, 62; 173/57, 39, 37, 160; 408/714, 226, 180, 187

[56] References Cited

U.S. PATENT DOCUMENTS

| | | | |
|---|---|---|---|
| 1,567,829 | 1/1924 | Bettis | 175/394 |
| 2,631,822 | 3/1953 | Ussery | 175/220 |
| 2,647,726 | 8/1953 | Kirk | 175/62 X |
| 2,661,929 | 12/1953 | Aspelin | 175/220 X |
| 2,665,117 | 1/1954 | Ivey | 175/62 X |
| 2,835,472 | 5/1958 | Osborn | 175/62 X |
| 2,879,033 | 3/1959 | Edwards et al. | 175/62 X |
| 3,986,570 | 10/1976 | Stinson et al. | 175/394 X |

FOREIGN PATENT DOCUMENTS

| | | | |
|---|---|---|---|
| 932146 | 8/1973 | Canada | 175/62 |

*Primary Examiner*—Ernest R. Purser
*Assistant Examiner*—Michael Starinsky
*Attorney, Agent, or Firm*—Gilbert A. Thomas

[57] ABSTRACT

A hole drilling machine which includes a geared stationary drill frame with a guide track to which support legs are attached at either end. A drive shaft made of hollow flexible tubing driven by a motor suspended from the guide track. An adjustable swivel axel to which the drill end is mounted. The drill end is a hollow tube with openings in an end to permit streams of water to wash loose soil out of the hole and assist in the drilling process and a helical knife edge attached thereto. An angled metal piece with exit holes to permit the flow of water is attached to the working end.

3 Claims, 4 Drawing Figures

PORTABLE VARIABLE ANGLE DRILLING MACHINE

BACKGROUND OF THE INVENTION

1. Field of the Invention

This invention relates to a ground drilling machine for use with non-hardened materials particularly all kinds of dirt, sand and other materials encountered in construction. The invention is particularly adaptable for drilling a hole underneath a sidewalk or curb and can be used for the installation of a sprinkler system or drain pipes or electricity after a building is contructed and when the accompanying concrete areas are in place.

2. Description of the Prior Art

The prior art machines like U.S. Pat. No. 3,696,874 are heavy, cumbersome to use and generally employ two or more men to utilize properly although only operated by one man.

SUMMARY OF THE INVENTION

In construction projects the concrete areas are often in place when the contracts are let for sprinkler systems, lighting, special drains or other underground facilities. Using the machines of the prior art is cumbersome and often the holes collapse if the material drilled is soft.

It is therefore an object of this invention to provide a non-hardened material drilling machine for drilling holes under concrete or other hard materials.

Another object of this invention is to provide a non-hardened material drilling machine that is lightweight and only requires one man for installation and operation.

Still a further object of this invention is to provide a single guide track machine with a hollow flexible drive shaft mounted underneath for drilling holes under hard surfaces.

A still further object of this invention is to attach city water to the machine, run it through the drive shaft and drill and use the water jets to assist the drilling operation and wash out the loose material dislodged by the drill.

Another object of the invention is to provide a drilling machine that weighs under 100 pounds and is portable and capable of being moved.

It is still another object of this invention to provide a drilling machine with an adjustable swivel axle and flexible shaft that enables the machine to drill above or below obstacles.

These novel features are believed to be characteristic of this invention. Further objects and advantages will be apparent for those skilled in the art from the following drawings and description.

DESCRIPTION OF THE PREFERRED EMBODIMENT

Figure 1:
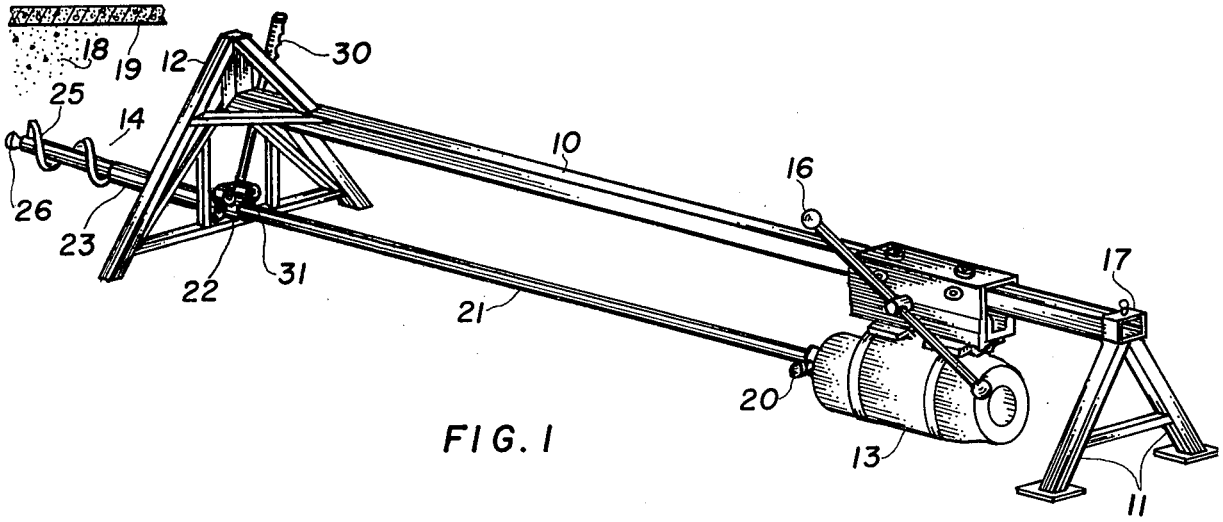
FIG. 1 is a top view of the invention.

In FIG. 1 is pictured the geared guide frame 10, the end supports legs 11 and 12, the electric motor 13 and the drilling end 14.

Figure 2:
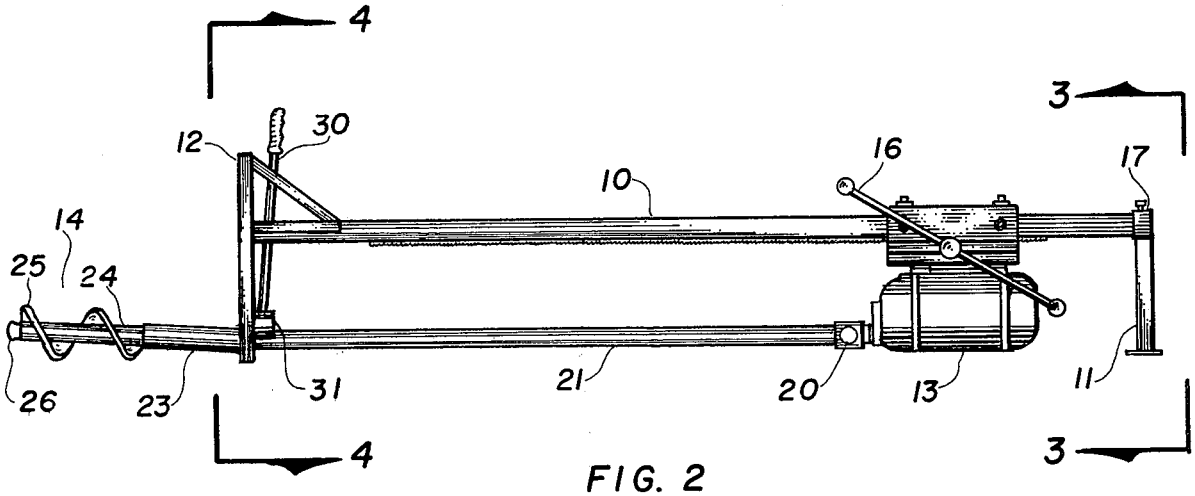
FIG. 2 is a side view of the invention
Figure 3:
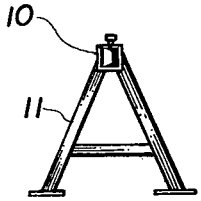
FIG. 3 is an end view of the invention.
Figure 4:
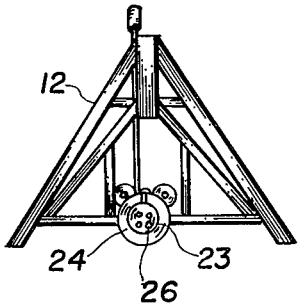
FIG. 4 is a detailed view of the drill end of the invention.

FIG. 2 gives a clearer picture of the apparatus. There the geared guide frame 10 is shown surrounded by the drive mechanism that is engaged by lever 16 from motor 13. A water jacket with water intake 20 envelopes the drive axle of the motor 13. A hollow drive shaft 21 is attached to the drive axle within the water jacket. It can be composed of 1" polyvinylchloride sprinkler line or similar material that is low in cost and flexible.

The drive shaft 21 is connected to alignable drill shaft 14 which is comprised of a swivel axle 22, a sleeve 23 through which a hollow shaft 24 extends to connect with drive shaft 21. A helical blade 25 is attached to the hollow tube 24 running at most three-fourths the way down tube 24 with an angled metal end with water holes 26 to spray water to assist in drilling and wash away accumulated debris. A handle 30 and dual rollers 31 which are attached to a reverse U-shaped collar swivel axle assembly, one roller being attached to each side of the inverted U, the hollow drive shaft 21 rests upon the rollers 31. A handle 30 is frictionally attached to one of the rollers and allows the end 14 to pivot in two directions, up and down, as the handle is gradually activated controlling the angle of entry of the drill end 26.

A lock screw 27 on a collar 17 welded to the apex of the legs 11 tightens on the end of frame 10 and enables the machine to be rigidly locked in place and yet permits the leg 11 to be moved anywhere on drive shaft 10 to obtain rigidity. The hollow collar 17 is slideably attached to drive shaft 10 and is fastened to legs 11.

In practice, the machine may be transmitted to the workplace with the leg 11 removed. It is assembled in place with the drill end beneath the hard surface. The leg 11 are attached to drive shaft 10 and lock screw 27 tightened. Water is next attached to jacket 20. This fills drive tube 21 and exits through the holes in the end 26. This wets the end of the soft surface 18, washes away loose material and makes it easier for the end 14 to create the hole. The motor 13 is next engaged to the drive shaft 10 by turning handle 16. As it moves down shaft 10 the drill end 14 creates a hole under the hard surface 19 through which cables or pipe can be placed.

This and other uses of the invention will be obvious to those skilled in the art.

I claim:

1. A soft material drilling machine for use in drilling holes under a hard surface comprising in combination a geared support shaft;

two sets of triangular legs;

one set moveably attached to the end opposite the hole drilling end;

a motor mounted to a geared rack attached to a support shaft;

a means to engage the geared rack to the support shaft; and, the invention which consists of a long hollow, flexible plastic drive shaft means connected on one end to a motor and the other end to a hollow drill means;

a water jacket around the end closest to the motor with the water inlet;

a collar swivel axle assembly to contain the drill shaft;

a dual roller, one roller attached to each side of an inverted U-shaped collar-swivel axel assembly, and a handle frictionally mounted to the swivel axle and capable of moving the plastic drive shaft in two directions; and, holes on the front end of the drill to exit the water.

2. A drill shaft means as in claim 1 which comprises in combination;

a hollow tube with a knife edge wound helically around, at most, three-fourths of it;

attached thereto and contained therein an inverted U-shaped collar in which the last one-fourth of the tube fits and to which two rollers attached by a U-shaped collar-swivel axel assembly with a handle frictionally attached to one of two rollers in the collar swivel axle assembly capable of swiveling the hollow tube in two directions—up and down.

3. A drill means as in claim 1 in which:

an angled metal end piece with water exit holes therein attached to the end of the hollow tube opposite the end inserted in the collar.

* * * * *